US007090390B2

(12) United States Patent
Pazula

(10) Patent No.: US 7,090,390 B2
(45) Date of Patent: Aug. 15, 2006

(54) REMOVABLE INCANDESCENT LIGHT BULB BASE PERMITTING CONVERSION TO FLUORESCENT LIGHTING PRODUCTS

(75) Inventor: Bruce Raymond Pazula, Broadview Heights, OH (US)

(73) Assignee: The L.D. Kichler Co., Cleveland, OH (US)

( * ) Notice: Subject to any disclaimer, the term of this patent is extended or adjusted under 35 U.S.C. 154(b) by 0 days.

(21) Appl. No.: 11/033,090

(22) Filed: Jan. 10, 2005

(65) Prior Publication Data

US 2006/0044842 A1 Mar. 2, 2006

Related U.S. Application Data

(60) Provisional application No. 60/605,597, filed on Aug. 30, 2004.

(51) Int. Cl.
*H01R 33/02* (2006.01)

(52) U.S. Cl. ..... 362/650; 362/378; 362/377; 362/353

(58) Field of Classification Search ..... 362/378, 362/353, 377, 650, 649, 651, 433, 435, 437, 362/441, 443, 448, 457, 446; 439/236, 336, 439/226

See application file for complete search history.

(56) References Cited

U.S. PATENT DOCUMENTS 5,286,216 A * 2/1994 Volz ..... 439/236
5,980,072 A * 11/1999 Zirkle ..... 362/477
6,113,433 A * 9/2000 Al-Turki ..... 439/639
2004/0264187 A1* 12/2004 Vanderschit ..... 362/235

OTHER PUBLICATIONS

Viva Green Lighting Model SU13 Product Specification, Shanghai Viva Eco. Electronics and Technology Co., Ltd., Revised May 11, 2004.

* cited by examiner

*Primary Examiner*—Ali Alavi
*Assistant Examiner*—B Q Truong
(74) *Attorney, Agent, or Firm*—Calfee, Halter & Griswold LLP

(57) ABSTRACT

A removable incandescent light bulb socket having: (a) a housing having at least first and second ends and an axis, having at least one opening at the first end, and the housing made at least in part of a heat-resistant material resistant to a temperature of about 90° C.; (b) threads within the opening for accepting and electrically connecting to a screw thread contact of an Edison base incandescent light bulb; (c) a central contact within the opening for electrically connecting to an electrical foot contact of the Edison base incandescent light bulb; and (d) first and second electrical contacts extending from the second end of the housing substantially parallel to the housing axis for mechanical and electrical connection to the electrical lighting base; and wherein the first and second electrical contacts have central axes and are positioned so that their central axes are approximately parallel; and further wherein the first and second electrical contacts each have a narrower proximal portion and a wider distal portion, the wider distal portion being configured to be accepted by the wider portion of the openings of the electrical lighting base and retained in the narrower portion of the openings of the electrical lighting base.

27 Claims, 9 Drawing Sheets

REMOVABLE INCANDESCENT LIGHT BULB BASE PERMITTING CONVERSION TO FLUORESCENT LIGHTING PRODUCTS

CROSS-REFERENCE TO RELATED APPLICATIONS

This application claims priority to, and any other benefit of, U.S. Provisional Application Ser. No. 60/605,597, filed on Aug. 30, 2004, and entitled METHODS AND SYSTEMS FOR CONVERTING INCANDESCENT LIGHTING PRODUCTS TO FLUORESCENT LIGHTING PRODUCTS (the '597 Appl'n), which is hereby incorporated by reference in its entirety. This application is related to U.S. patent application Ser. No. 11/032,807, filed herewith and entitled METHODS FOR CONVERTING INCANDESCENT LIGHTING PRODUCTS TO FLUORESCENT LIGHTING PRODUCTS and which also claims the benefit of the '597 Appl'n.

FIELD OF THE INVENTION

The present invention relates generally to lighting fixtures and portables, and more particularly to converting an incandescent lighting fixture or portable to a lower power fluorescent lighting fixture or portable, to replaceable incandescent light bulb bases to facilitate this conversion, and to fixtures and portables that are capable of undergoing this conversion.

BACKGROUND OF THE INVENTION

As known in the art, fluorescent light bulbs generally are more energy-efficient than conventional incandescent light bulbs. At the same time, however, incandescent light bulbs may have advantages over fluorescent light bulbs. For example, incandescent light bulbs tend to be less expensive than fluorescent bulbs and do not require a ballast, as fluorescent bulbs do. Accordingly, on some occasions fluorescent bulbs may be preferable to incandescent bulbs, on other occasions incandescent bulbs are preferable, and on other occasions, either will suffice. In this time of energy conservation, it is common for energy-efficient products to be certified as energy efficient by various organizations, e.g., ENERGY STAR ("a government-backed program helping businesses and individuals protect the environment through superior energy efficiency").

It is known to have fluorescent bulbs with built-in ballasts for use in incandescent light bulb sockets; however lighting products (i.e., lighting fixtures and/or lighting portables) with standard incandescent light bulb sockets may face hurdles in becoming certified as energy-efficient because one can readily use incandescent bulbs in the medium bases (Edison bases) of such lighting products.

SUMMARY OF THE INVENTION

A removable incandescent light bulb socket for being electrically and mechanically coupled to an electrical lighting base having at least two openings, each opening having a wider portion and a narrower portion, comprising: (a) a housing having at least first and second ends and an axis, having at least one opening at the first end, and the housing made at least in part of a heat-resistant material resistant to a temperature of about 90° C.; (b) threads within the opening for accepting and electrically connecting to a screw thread contact of an Edison base incandescent light bulb; (c) a central contact within the opening for electrically connecting to an electrical foot contact of the Edison base incandescent light bulb; and (d) first and second electrical contacts extending from the second end of the housing substantially parallel to the housing axis for mechanical and electrical connection to the electrical lighting base; and (e) wherein the first electrical contact is electrically connected to the housing threads to provide electricity from the electrical lighting base to the screw thread contact of the Edison base incandescent light bulb, (f) wherein the second electrical contact is electrically connected to the central contact to provide electricity from the electrical lighting base to the electrical foot contact of the Edison base incandescent light bulb; (g) wherein the first and second electrical contacts have central axes and are positioned so that their central axes are approximately parallel; and (h) further wherein the first and second electrical contacts each have a narrower proximal portion and a wider distal portion, the wider distal portion being configured to be accepted by the wider portion of the openings of the electrical lighting base and retained in the narrower portion of the openings of the electrical lighting base. Other embodiments may include means for preventing the removable incandescent bulb socket from being re-coupled to the electrical lighting base responsive to a low-energy usage triggering event.

BRIEF DESCRIPTION OF THE DRAWINGS

In the accompanying drawings, which are incorporated in and constitute a part of this specification, embodiments of the invention are illustrated, which, together with a general description of the invention given above, and the detailed description given below, serve to exemplify the principles of this invention, wherein.

DETAILED DESCRIPTION OF THE INVENTION

Figure 1B:
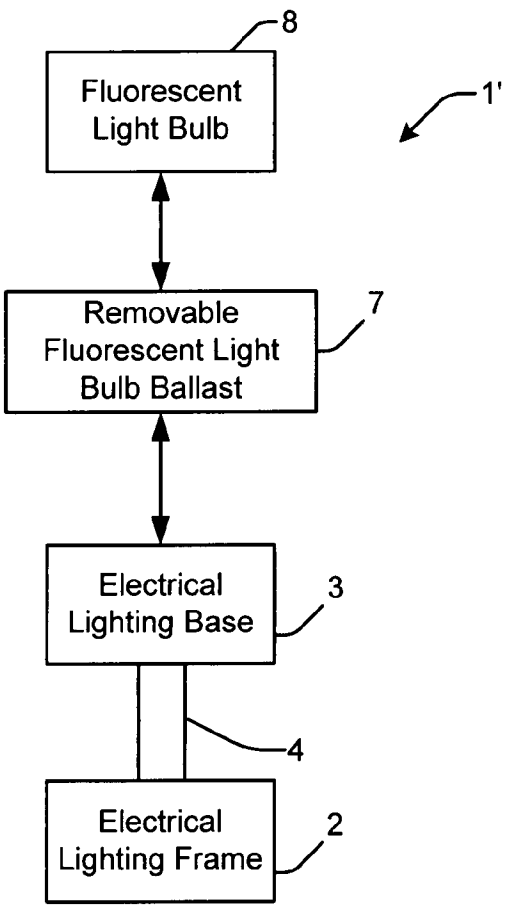
FIGS. 1A and 1B are schematic block diagrams of exemplary lighting products according to the present invention.

The following includes definitions of exemplary terms used throughout the disclosure. Both singular and plural forms of all terms fall within each meaning. Except where noted otherwise, capitalized and non-capitalized forms of all terms fall within each meaning:

As used herein, "electrical lighting base" includes, but is not limited to necessarily require, a structure carried by a lighting product frame that is proximate and providing support for removable lighting members, such as sockets and ballasts. An "electrical lighting base" preferably ("preferably" as used in this application means "preferably, but not necessarily" and "preferable" as used in this application means "preferable, but not necessary") also provides electricity to removable lighting members, lighting sockets and ballasts. In the alternative, an electrical lighting base may provide mechanical support for removable lighting members and electricity is provided via separate conductors, e.g., a wire with a connector being connected to a mating connector on the removable lighting member. The term "electrical lighting base" as used herein is contrasted with common "bases" of lamps or other portables, which tend to be at the bottom of the lamp or portable and that provide mechanical support and stability, e.g., by being relatively heavy and/or by being flared at the bottom.

As used herein, "circuit" (synonymous with "logic" as used herein) includes, but is not limited to necessarily require, hardware, firmware, software and/or combinations of each to perform a function(s) or an action(s). For example, based on a desired application or needs, a circuit may include a software controlled microprocessor, discrete logic such as an application specific integrated circuit (ASIC), or other programmed logic device. A circuit may also be fully embodied as software.

As used herein, "circuit communication" indicates a communicative relationship between devices, logic, and/or circuits. Direct electrical, electromagnetic, and optical connections and indirect electrical, electromagnetic, and optical connections are examples of circuit communication. Two devices are in circuit communication if a signal from one is received by the other, regardless of whether the signal is modified by some other device. For example, two devices separated by one or more of the following—amplifiers, filters, transformers, optical isolators, digital or analog buffers, analog integrators, other electronic circuitry, fiber optic transceivers, Bluetooth communications links, 802.11 communications links, or even satellites—are in circuit communication if a signal from one is communicated to the other, even though the signal is modified by the intermediate device(s). As another example, an electromagnetic sensor is in circuit communication with a signal if it receives electromagnetic radiation from the signal. As a final example, two devices not directly connected to each other, but both capable of interfacing with a third device, e.g., a CPU, are in circuit communication.

As used herein, a second structure being "in place of" a first structure indicates that the second structure is being positioned so as to occupy at least some (but not necessarily all) of the relative volume taken up by the first structure when previously positioned. For example, coupling at least one ballast and at least one fluorescent light bulb to at least one electrical lighting base carried by the frame in place of a removed incandescent bulb socket (i.e., FIG. 9 vis-à-vis FIG. 2) indicates that the ballast/fluorescent bulb combination occupies at least some (but not necessarily all) of the volume that the incandescent bulb base of the removed incandescent bulb socket when previously positioned. In this example, the fluorescent bulb itself need not occupy any (but may occupy some) of the volume that was taken up by the incandescent bulb socket when previously positioned, but the ballast/fluorescent bulb combination does so.

The present invention is directed toward systems and methods for converting incandescent lighting products to fluorescent lighting products and preferably for irreversibly converting incandescent lighting products to fluorescent lighting products.

Figure 1A:
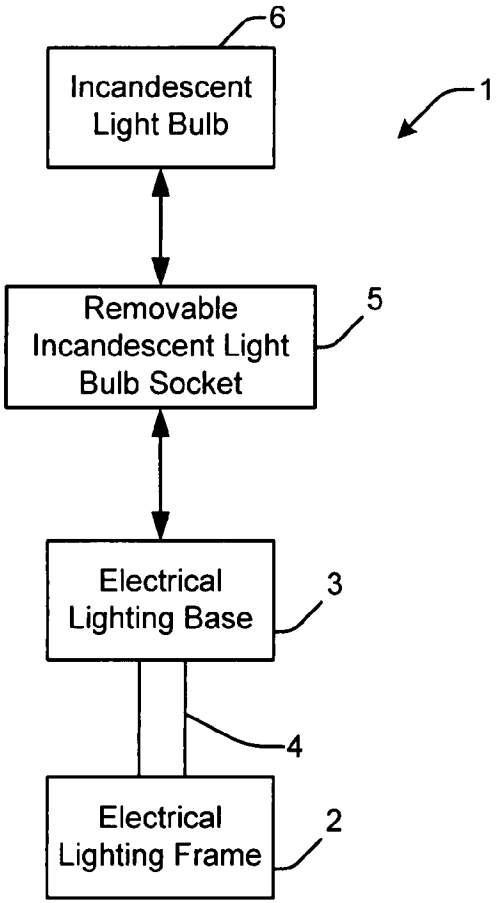

Referring now to the drawings, FIGS. 1A and 1B are high-level block diagrams showing exemplary lighting products 1 and 1' (i.e., lighting fixtures and/or portables) according to the present invention. Exemplary lighting product 1 comprises a frame or body 2 directly or indirectly carrying at least one electrical lighting base 3. The base 3 may be carried by one or more structures, e.g., carried by at least one arm 4, of the lighting product 1. The base 3 removably receives and is electrically coupled to, a removable incandescent bulb socket 5, which accepts an incandescent light bulb 6. Electricity powering the incandescent light bulb 6 is provided via the electrical lighting base 3 to the socket 5. As shown in FIG. 1B, the electrical lighting base 3 also removably receives a fluorescent light bulb ballast 7 for a fluorescent light bulb 8. The fluorescent light bulb ballast 7 is preferably removable to permit replacement when the ballast fails. Electricity powering the fluorescent light bulb 8 is provided via the lighting base 3 to the ballast 7. Preferably, the electrical lighting base 3 may be both mechanically coupled and electrically coupled to the removable incandescent bulb socket 5 and/or the removable ballast 7, e.g., the base 3 has openings for accepting and retaining electrical contacts (not shown in FIGS. 1A and 1B) of the removable incandescent bulb socket 5 and the ballast 7.

According to an exemplary method of the present invention, lighting products having at least one of such bases 3 are preferably provided, preferably with corresponding removable incandescent light bulb sockets 5 in place (with or without incandescent light bulbs 6 installed). On the one hand, for incandescent use, the product may be used without regard to the base 3 or socket 5; incandescent bulbs 6 are installed and the product may be used. On the other hand, for fluorescent use, the removable incandescent bulb sockets 5 may be removed from the base 3 and replaced with fluorescent ballasts 7 and fluorescent bulbs 8. Preferably, the removal of the removable incandescent bulb sockets 5 and replacement with fluorescent ballasts 7 and fluorescent bulbs 8 may be done by virtually anyone, with or without special tools or equipment, including by personnel in a distribution chain for the lighting product and/or by an installer and/or by an end user. The ballasts 7 are preferably removable ballasts.

Preferably the removable incandescent bulb socket 5 may be removed from the base 3 and replaced with a fluorescent ballast 7, preferably a removable ballast 7. The removable incandescent bulb socket 5 and the removable ballast 7 may be freely exchanged, with one being removed from the base 3 and the other being coupled to the base 3 in its place. In the alternative, according to the present invention it may be helpful, e.g., for energy-efficiency certification, to prevent a removable incandescent bulb socket 5 from being re-coupled (e.g., reconnected) to the electrical lighting base 3 when either (i) the removable incandescent bulb socket 5 has been removed from the electrical lighting base 3 or (ii) a fluorescent lighting ballast has been coupled to the electrical lighting base 3, or (iii) both the removable incandescent bulb socket 5 has been removed from the electrical lighting base 3 and a fluorescent lighting ballast has been coupled to the electrical lighting base 3, or responsive to some other low-energy usage triggering event.

This may be accomplished by any one or more means for preventing a removable incandescent bulb socket 5 from being re-coupled to the electrical lighting base 3, e.g., (a) any one or more spring-loaded electrical contacts associated with the base 3 and/or socket 5 and/or ballast 7 that initially provide electricity to the bulb 6, but that extend or retract when any of the three foregoing conditions are met to effectively prevent a removable incandescent bulb socket 5 from being mechanically and/or electrically re-coupled to the electrical lighting base 3; and/or (b) any one more spring-loaded pins, cams, guides, or other structures associated with the base 3 and/or socket 5 and/or ballast 7 that initially are out of the way, but that extend or retract to physically interfere with other structures when any of the three foregoing conditions are met to effectively prevent a removable incandescent bulb socket 5 from being mechanically and/or electrically re-coupled to the electrical lighting base 3; and/or (c) a bulb socket 5 that separates into two or more pieces, rendering it unusable, during the process of meeting any of any of the three foregoing conditions, e.g., the socket 5 breaks into two or more pieces when it is removed from or released from the base 3; and/or (d) any one more spring-loaded pins, cams, guides, or other structures associated with the base 3 and/or socket 5 and/or a non-removable ballast that initially are out of the way, but that extend or retract to physically interfere with other structures when any of the three foregoing conditions are met to effectively prevent the non-removable ballast from being removed from the base 3 (in this case the removable incandescent bulb socket 5 is prevented from being reconnected to the electrical lighting base 3 by the fluorescent ballast 7, which is prevented from being removed and which blocks the socket 5 from being re-coupled to the base 3); and/or (e) any one more rings, bands, bridges, ties, tape, films, or other structures associated with the base 3 and/or socket 5 that initially affix the socket 5 to the base 3 so that the socket 5 is mechanically and electrically coupled to the base 3, which are rings, bands, bridges, ties, tape, films, or other structures cut or otherwise severed or disengaged when any of the three foregoing conditions are met (e.g., in order to do so) so that there is not sufficient structure to re-connect the removable incandescent bulb socket 5 in mechanical connection and/or electrical reconnection to the electrical lighting base 3; and/or (f) electronic circuitry in the base 3 and/or socket 5 (and/or perhaps somewhere else in the lighting product, e.g., in the base of a portable or in the plate of a fixture) that prevents an incandescent light bulb socket from properly functioning once one of the three foregoing conditions has been met (all not shown in FIGS. 1A and 1B). This circuitry may detect energy usage levels of the lighting product, or a part thereof, and/or detect signals generated by a functioning fluorescent lighting ballast, and responsively thereafter prevent higher-energy usage, as would be expected to permit an incandescent light bulb to function.

In the exemplary method of the present invention discussed above, it is preferable for any bases 3 and/or any removable incandescent light bulb sockets 5 and/or any fluorescent light ballasts 7 to include one or more of the foregoing means for preventing a removable incandescent bulb socket 5 from being reconnected to the electrical lighting base 3 when either (i) the removable incandescent bulb socket 5 has been removed from the electrical lighting base 3 or (ii) a fluorescent lighting ballast has been coupled to the electrical lighting base 3, or (iii) both the removable incandescent bulb socket 5 has been removed from the electrical lighting base 3 and a fluorescent lighting ballast has been coupled to the electrical lighting base 3, or responsive to some other low-energy usage triggering event.

Figure 2:
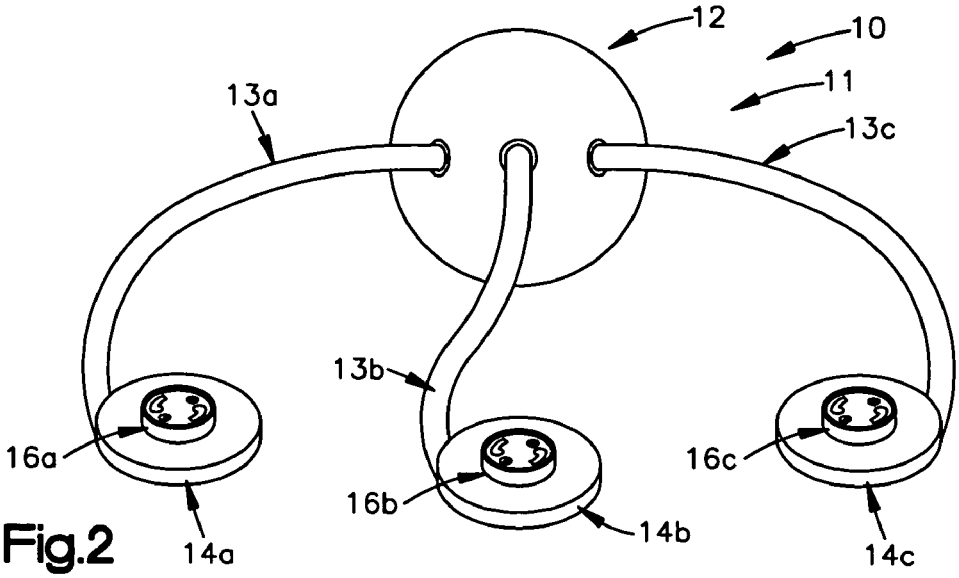
FIGS. 2, 3A, and 3B are front views of exemplary lighting fixtures according to the present invention.
Figure 3A:
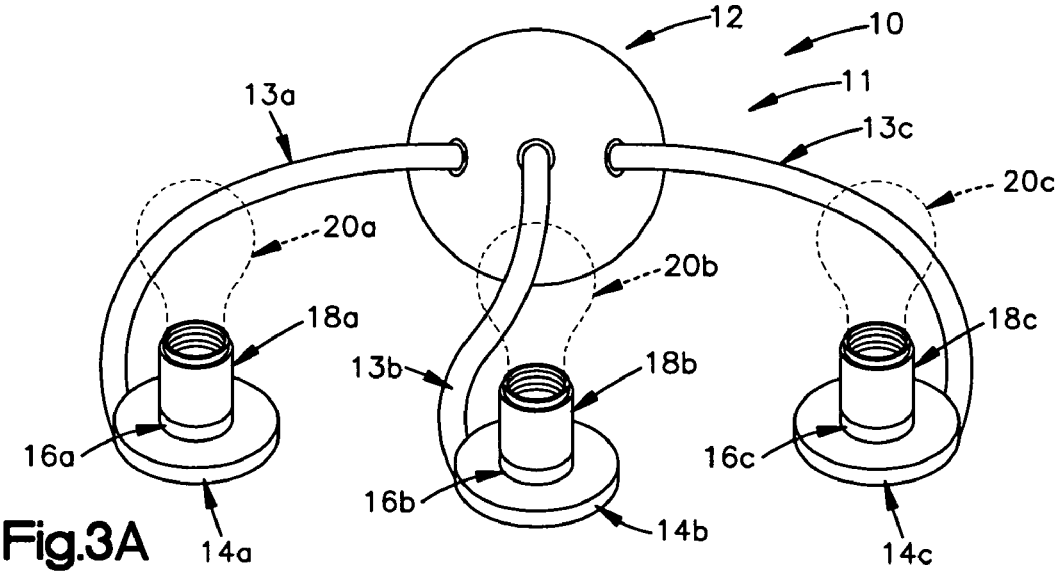
Figure 3B:
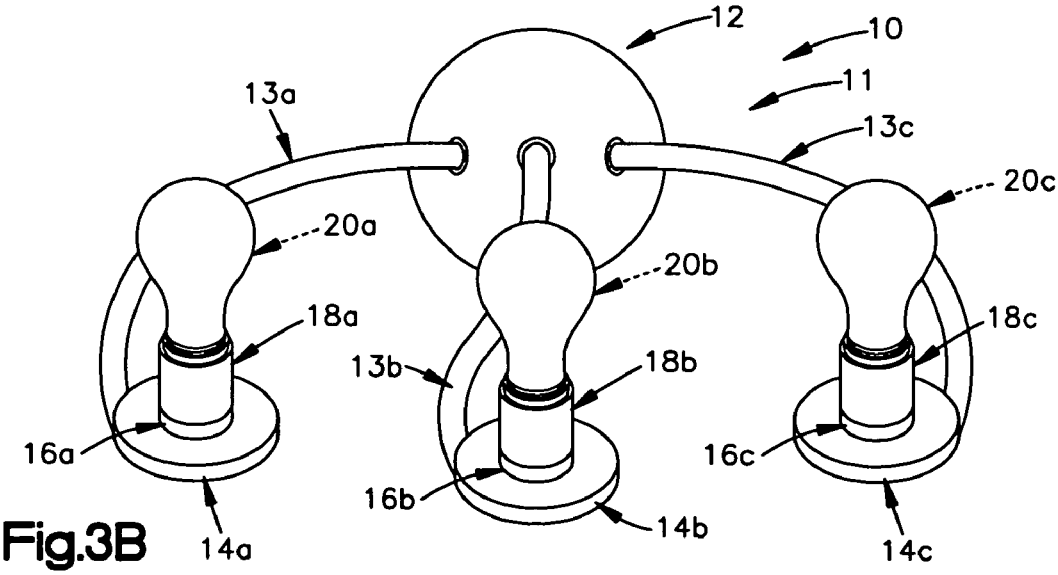

FIG. 2 and FIGS. 3A and 3B illustrate an exemplary lighting fixture 10 of the present invention in various configurations. The exemplary lighting fixture 10 shown has a frame 11, having a body 12 and three arms 13*a*, 13*b*, and 13*c*, with each arm 13*a*, 13*b*, and 13*c* carrying a bobeche 14, also known as a socket cup holder 14 (referred to as bobeches 14*a*, 14*b*, and 14*c*, respectively), each of which bobeche 14 in turn carries an electrical lighting base 16 (referred to as base 16*a*, 16*b*, and 16*c*, respectively). Thus, the frame 11 carries at least one electrical lighting base 16, with each of the three arms 16 carrying an electrical lighting base 16. In the configurations of FIGS. 3A and 3B, the bases 16*a*, 16*b*, and 16*c* are shown coupled to three removable incandescent bulb sockets 18*a*, 18*b*, and 18*c*, and in turn, the three incandescent bulb sockets 18*a*, 18*b*, and 18*c* are removably receiving three incandescent light bulbs 20*a*, 20*b*, and 20*c*. It will be appreciated that lighting fixtures of the invention may have any number of and configuration of arms and bases. Lighting products according to the present invention are preferably shipped in the configuration of FIG. 3A, with the removable incandescent light bulb sockets 18 connected to the bases 16, ready to install and accept incandescent light bulbs for incandescent lighting; although they also may be shipped in other configurations, such as the configuration of FIG. 2 having an associated removable incandescent bulb socket shipped separately or therewith for coupling to each base 16 at a later point in time.

Figure 4:
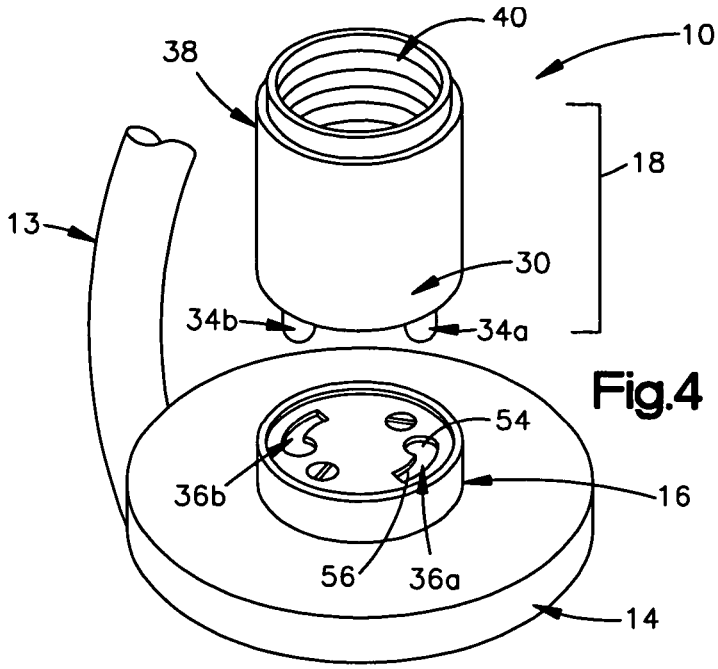
FIG. 4 is an enlarged view of the electrical lighting base and removable incandescent bulb socket of the exemplary lighting fixtures shown in FIGS. 3A and 3B.
Figure 5:
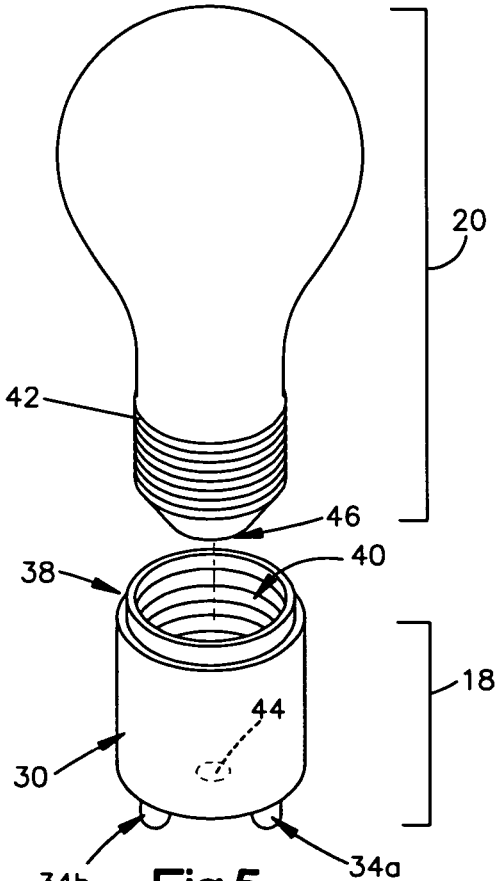
FIGS. 5 and 6 are additional views of the bulb socket shown in FIGS. 1, 2, and 4, with incandescent light bulbs.
Figure 6:
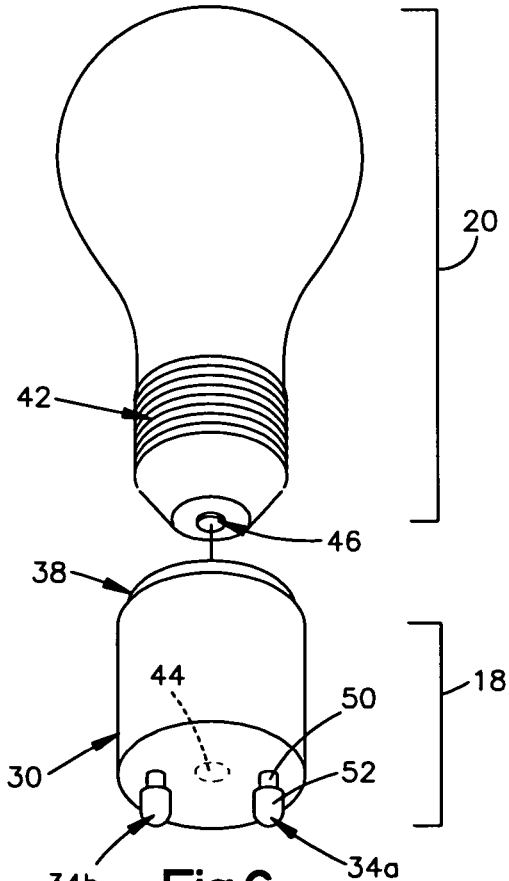

FIGS. 4–6 illustrate the electrical lighting base 16 and incandescent bulb socket 18 of the exemplary lighting fixtures shown in FIGS. 3A and 3B. The base 16 is shown being carried by a bobeche 14, which is carried by arm 13 of frame 11. The base 16 is adapted to removably receive a first end 30 of an incandescent bulb socket 18 to preferably both mechanically couple and electrically couple the socket 18 to the base 16. The first end 30 of socket 18 may be adapted to be removably received by the base 16 in any desirable manner. For example, in the configuration shown in FIG. 4, the first end 30 of the incandescent bulb socket 18 has two extensions (pins or pillars 34*a* and 34*b*) extending from the first end 30 of the incandescent bulb socket 18. In the particular embodiment shown, the longitudinal axes of the pins 34*a* and 34*b* are preferably substantially parallel to the longitudinal axis of the incandescent bulb socket 18. The exemplary base 16 of FIG. 4 has two openings 36*a* and 36*b* adapted to removably receive pins 34*a* and 34*b*.

The incandescent bulb socket 18 also has a second end 38 that is adapted to receive and deliver electricity to an incandescent light bulb 20. The second end 38 of socket 18 also has an opening with threads 40 to removably engage threads 42 on an incandescent light bulb 20 to deliver electricity to the incandescent light bulb 20 as known to those skilled in the art. Inside the socket 18 is a central contact 44, which preferably lies along the axis of the threads 40 (i.e., screw thread contact 40) and contacts a central contact 46 (i.e., electrical foot contact 46 a/k/a base contact 46) of light bulb 20 to provide electricity to the light bulb when the light bulb has been screwed into place, as known to those skilled in the art.

Pins 34*a*, 34*b* are preferably electrical conductors that provide electricity from the base 16 to the socket 18 for light bulb 20. Wiring or other electrical conductors electrically connect one of the pins 34 to the threads 40 and separate wiring or other conductors electrically connect the other of the pins 34 to the central contact 44. Pins 34*a*, 34*b* preferably both mechanically couple and electrically couple the socket 18 to the base 16. In the exemplary configuration shown, the incandescent bulb socket 18 is removably coupled to the base 16 by inserting the extensions 34*a* and 34*b* into the openings 36*a* and 36*b* and turning the incandescent bulb socket 18 in a clockwise manner relative to the base 16. The openings 36 in base 16 preferably have associated electrical contacts electrically coupled to wiring (or other conductors) passing through or adjacent arm 13. These electrical contacts of base 16 engage pins 34*a*, 34*b* to provide electricity to the base 16 to the socket 18 for the light bulb 20.

More specifically to FIGS. 4 and 6, the pins 34*a*, 34*b* of the exemplary incandescent light bulb socket 18 are shown having two portions, a narrower portion 50 and wider portion 52. Similarly, the openings 36*a*, 36*b* of base 16 also have a wider portion 54 and a narrower portion 56. The wider portion 54 of openings 36*a*, 36*b* are sized to accommodate the wider portion 52 of one or more pins 34*a*, 34*b*. The wider portion 54 of openings 36*a*, 36*b* may be about 0.23" or some other dimension larger than the wider portion 52 of one or more pins 34*a*, 34*b*. Similarly, the wider portion 52 of one or more pins 34*a*, 34*b* may be about 0.19" or some other dimension smaller than the wider portion 54 of openings 36*a*, 36*b*. The narrower portion 50 of openings 36*a*, 36*b* are sized to accommodate the narrower portion 50 of one or more pins 34 but not to permit the wider portion 52 of one or more pins 34 to pass through. The narrower portion 50 of openings 36*a*, 36*b* may be about 0.14" or some other dimension larger than the narrower portion 50 of one or more pins 34 and smaller than the wider portion 52 of one or more pins 34. Similarly, the narrower portion 50 of one or more pins 34 may be about 0.13" or some other dimension smaller than the narrower portion 50 of openings 36*a*, 36*b*. The pins 34*a*, 34*b* may be first and second electrical contacts having central axes that are positioned so that their central axes are approximately parallel and are spaced about 23 mm apart. Similarly, the Thus, in the exemplary configuration shown, the incandescent bulb socket 18 is removably coupled to the base 16 by (a) aligning the removable socket 18 with respect to the base 16 so that the longitudinal axes of the pins 34*a*, 34*b* are directed toward the wider portion 54 of openings 36*a*, 36*b*, (b) inserting the pins 34 into the openings 36 so that the wider portion 52 of pins 34*a*, 34*b* are entirely within the openings 36*a*, 36*b*, and (c) turning the incandescent bulb socket 18 in a clockwise manner relative to the base 16 so that the narrower portion 50 of openings 36*a*, 36*b* engage the narrower portion 50 of pins 34*a*, 34*b* and in such a manner that the wider portion 52 of pins 34*a*, 34*b* are prevented from being withdrawn, thus removably retaining the socket 18. Preferably, the wider portion 52 of pins 34*a*, 34*b* is placed in physical contact with the electrical contacts within the openings 36 to provide electricity to the socket 18 for the light bulb 20. The removable incandescent bulb sockets 18*a*–18*c* may be any suitable dimensions and virtually any shape and be made of any of many acceptable heat-resistant materials, such as bakelite polymer or ceramic. The bases 16*a*–16*c* also may be any suitable dimensions and virtually any shape and be made of any of many acceptable any of many acceptable heat-resistant materials, such as bakelite polymer or ceramic. The material(s) selected for the electrical lighting bases 16*a*–16*c* and removable incandescent bulb sockets 18*a*–18*c* are both preferably resistant to temperatures generated by ordinary incandescent light bulbs having a tungsten filament (~90° C.), e.g., a housing made of a ceramic material or bakelite polymer.

The electrical lighting base 16 of FIG. 4 may have the same configuration from as a VIVA GREEN LIGHTING brand model 3.07.03.30025(6) electrical lighting base (i.e., the base portion of VIVA GREEN LIGHTING brand removable fluorescent ballasts/base pairs, e.g., VIVA GREEN LIGHTING brand models SU13, SU16, SU23, etc.) (available from Shanghai VIVA Eco. Electronics & Technology Co., Ltd.) modified to be made of a material resistant to temperatures generated by ordinary incandescent light bulbs having a tungsten filament (~90° C.), e.g., made of a ceramic material or bakelite polymer. In the alternative, however, the electrical lighting base 16 may also comprise one or more of the foregoing means for preventing a removable incandescent bulb socket 18 from being reconnected to the electrical lighting base 16 when either (i) the removable incandescent bulb socket 18 has been removed from the electrical lighting base 16 or (ii) a fluorescent lighting ballast has been coupled to the electrical lighting base 16, or (iii) both the removable incandescent bulb socket 18 has been removed from the electrical lighting base 16 and a fluorescent lighting ballast has been coupled to the electrical lighting base 16, or responsive to some other low-energy usage triggering event (none of which are found in the VIVA GREEN LIGHTING brand model 3.07.03.30025(6) electrical lighting base).

Figure 7:
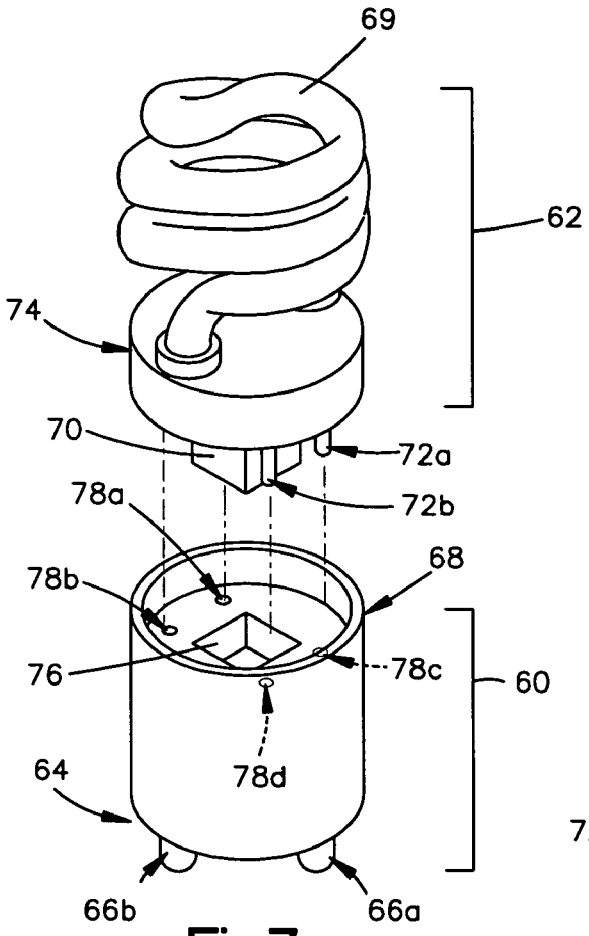
FIGS. 7 and 8 are views of a fluorescent light bulb and ballast.
Figure 8:
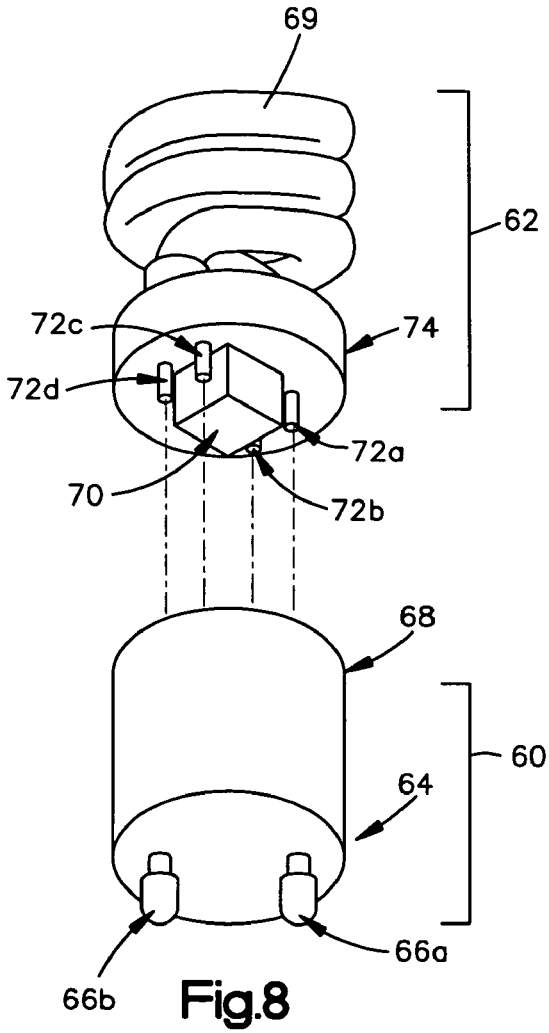

FIGS. 7 and 8 illustrate an exemplary removable ballast 60 and fluorescent light bulb 62 used in accordance with the various methods of the invention. The ballast 60 has a first end 64 that is adapted to be removably received by an electrical lighting base 16. In the particular embodiment shown, the first end 64 has two extensions (pins 66*a*, 66*b*) extending from the first end 64 of the ballast 60. Preferably, the longitudinal axes of the pins 66*a* and 66*b* are substantially parallel to a longitudinal axis of the ballast 60. In the embodiment shown, the external portion of pins 66*a*, 66*b* are substantially the same configuration (i.e., wider and narrower portions) as pins 34*a*, 34*b* of incandescent bulb socket 18 to permit the ballast 60 to be removably coupled to the base 16 by inserting the extensions 66*a* and 66*b* into the openings 36*a* and 36*b* and turning the ballast 60 in a clockwise manner relative to the base 16. The electrical contacts of base 16 engage pins 66*a*, 66*b* to provide electricity to the ballast circuitry within ballast 60.

The ballast 60 also has a second end 68 that is adapted to receive and deliver electricity to a fluorescent light bulb 62. In the particular illustrative embodiments shown, the fluorescent light bulb 62 has a tube 69, an alignment key 70 and four conductors 72*a*, 72*b*, 72*c*, and 72*d* extending from a first end 74 of the fluorescent light bulb 62. Preferably, the longitudinal axes of the extensions 70, 72*a*, 72*b*, 72*c*, and 72*d* are substantially parallel to the longitudinal axis of the ballast 60. Conductors 72*a*–72*d* are preferably contacts that extend into the fluorescent lamp, as known to those in the art. Finally, the second end 68 of the ballast 60, has five openings: opening 76, which accepts alignment key 70 and openings 78*a*, 78*b*, 78*c*, 78*d*, each of which accepts one of the conductors 72*a*–72*d*. As known to those skilled in the art, the ballast 60 provides proper voltages via contacts associated with openings 78*a*–78*d* to conductors 72*a*–72*d* to cause the gases within tube 69 to provide illumination. A suitable ballast is available from VIVA GREEN LIGHTING as model 3.07.03.30022 ballast (i.e., the ballast portion of VIVA GREEN LIGHTING brand removable fluorescent ballasts/base pair model SU13). Suitable fluorescent light bulbs compatible with this ballast are also available from Shanghai VIVA Eco. Electronics & Technology Co., Ltd. In the alternative, however, the ballast 60 may also comprise one or more of the foregoing means for preventing a removable incandescent bulb socket from being reconnected to the electrical lighting base when a fluorescent lighting ballast has been coupled to the electrical lighting base 16, or responsive to some other low-energy usage triggering event (none of which are found in the VIVA GREEN LIGHTING brand model 3.07.03.30022 ballast).

Figure 9:
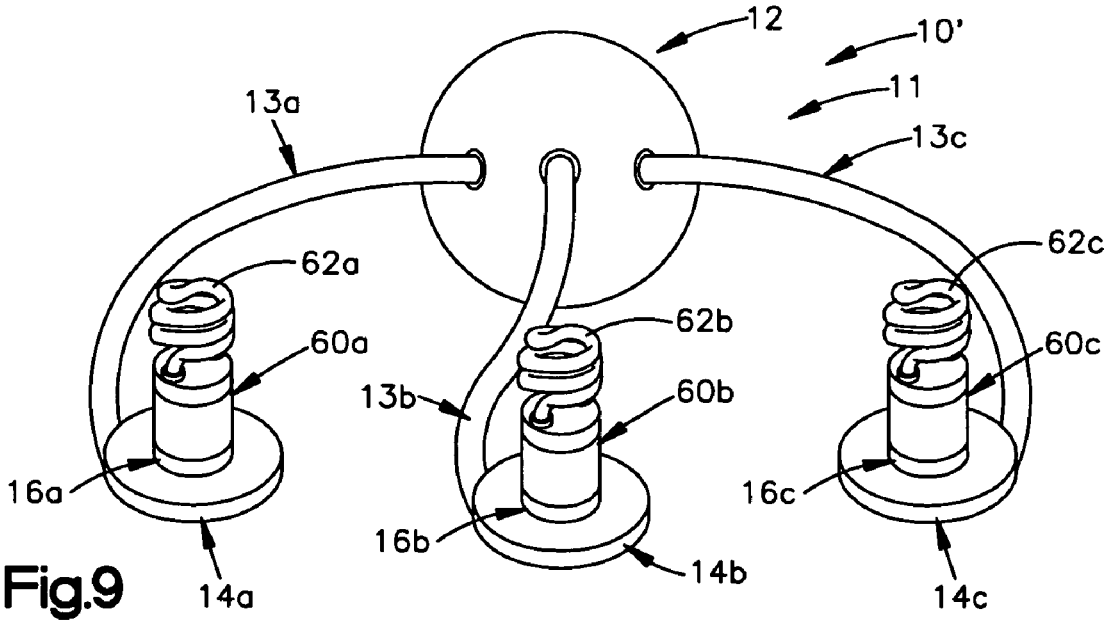
FIG. 9 is a side view of an exemplary fluorescent light fixture.
Figure 10:
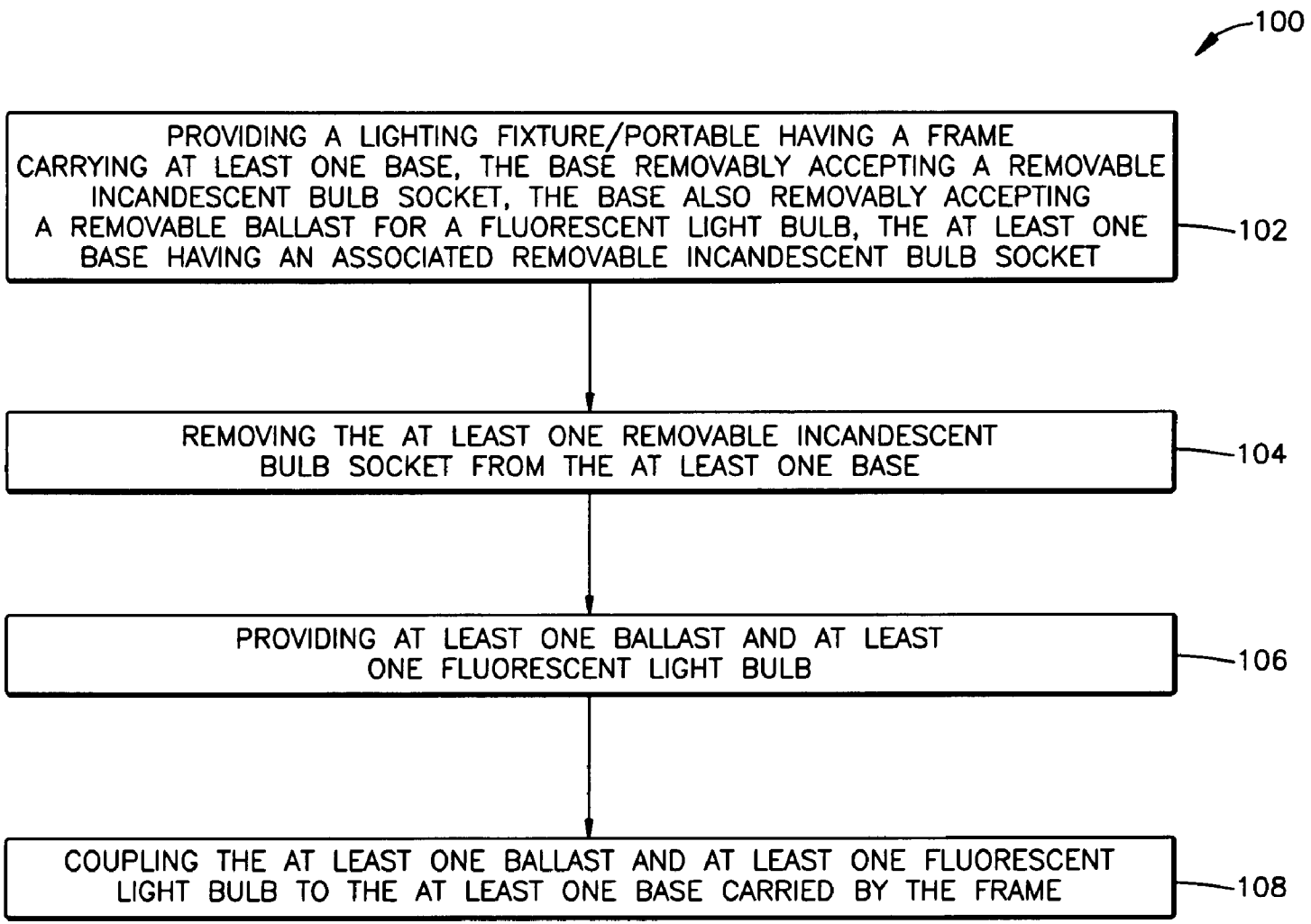
FIG. 10 is an exemplary method of converting an incandescent lighting fixture or portable to a lower power lighting fixture or portable.

FIG. 9 shows an exemplary fixture 10' resulting from performing an exemplary method 100 of the present invention, as shown in FIG. 10. Referring now to FIG. 10, the exemplary method 100 comprises a first step 102 of providing a lighting fixture or portable having a frame carrying at least one base, the base removably receiving a removable incandescent bulb socket, the base also removably receiving a ballast for a fluorescent light bulb, the at least one base having an associated removable incandescent bulb socket. Exemplary lighting fixtures resulting from this step are shown in FIGS. 3A and 3B (and in FIG. 2 with associated removable incandescent bulb sockets). Next at 104, the method continues by the at least one removable incandescent bulb socket being removed from the at least one base, resulting in a fixture exemplified by FIG. 2. Next, at step 106, at least one ballast and at least one fluorescent light bulb is provided, preferably one for each base 16. Finally, at step 108, the at least one ballast and at least one fluorescent light bulb is coupled to the at least one base carried by the frame.

The resulting exemplary fixture 10' shown in FIG. 9 has a frame 11, having a body 12 and three arms 13*a,* 13*b,* and 13*c,* with each arm 13*a,* 13*b,* and 13*c* carrying a bobeche 14 (referred to as bobeche 14*a,* 14*b,* and 14*c,* respectively), each of which bobeche 14 in turn carries an electrical lighting base 16 (referred to as base 16*a,* 16*b,* and 16*c,* respectively). Thus, the frame 11 carries at least one electrical lighting base 16, with each of the three arms 16 carrying an electrical lighting base 16. In the configurations of FIGS. 3A and 3B, the bases 16*a,* 16*b,* and 16*c* are shown coupled to three fluorescent ballasts 60*a,* 60*b,* and 60*c,* and in turn, the three fluorescent ballasts 60*a,* 60*b,* and 60*c* are receiving three fluorescent light bulbs 62*a,* 62*b,* and 62*c*.

Preferably the removable incandescent bulb socket 18 may be removed from the base 16 and replaced with a fluorescent ballast 60, preferably a removable ballast 60. The removable incandescent bulb socket 18 and the removable ballast 60 may be freely exchanged, with one being removed from the base 16 and the other being coupled to the base 16 in its place. In the alternative, according to the present invention it may be helpful, e.g., for energy-efficiency certification, to prevent a removable incandescent bulb socket 18 from being reconnected to the electrical lighting base 16 when either (i) the removable incandescent bulb socket 18 has been removed from the electrical lighting base 16 or (ii) a fluorescent lighting ballast has been coupled to the electrical lighting base 16, or (iii) both the removable incandescent bulb socket 18 has been removed from the electrical lighting base 16 and a fluorescent lighting ballast has been coupled to the electrical lighting base 16. This may be accomplished by any one or more means for preventing a removable incandescent bulb socket from being reconnected to the electrical lighting base, e.g., (a) any one or more spring-loaded electrical contacts associated with the base 16 and/or socket 18 and/or ballast 60 that initially provide electricity to the bulb 20, but that extend or retract when any of the three foregoing conditions are met to effectively prevent a removable incandescent bulb socket 18 from being mechanically and/or electrically reconnected to the electrical lighting base 16; and/or (b) any one more spring-loaded pins, cams, guides, or other structures associated with the base 16 and/or socket 18 and/or ballast 60 that initially are out of the way, but that extend or retract to physically interfere with other structures when any of the three foregoing conditions are met to effectively prevent a removable incandescent bulb socket 18 from being mechanically and/or electrically reconnected to the electrical lighting base 16; and/or (c) a bulb socket 18 that separates into two or more pieces, rendering it unusable, during the process of meeting any of any of the three foregoing conditions, e.g., the socket 18 breaks into two or more pieces when it is removed from or released from the base 16; and/or (d) any one more spring-loaded pins, cams, guides, or other structures associated with the base 16 and/or socket 18 and/or a non-removable ballast that initially are out of the way, but that extend or retract to physically interfere with other structures when any of the three foregoing conditions are met to effectively prevent the non-removable ballast from being removed from the base 16 (in this case the removable incandescent bulb socket 18 is prevented from being reconnected to the electrical lighting base 16 by the fluorescent ballast 60, which is prevented from being removed and which blocks the socket 18 from being re-coupled to the base 16); and/or (e) any one more rings, bridges, ties, tape, films, or other structures associated with the base 16 and/or socket 18 that initially affix the socket 18 to the base 16 so that the socket 18 is mechanically and electrically coupled to the base 16, which are rings, bridges, ties, tape, films, or other structures cut or otherwise severed or disengaged when any of the three foregoing conditions are met (e.g., in order to do so) so that there is not sufficient structure to re-connect the removable incandescent bulb socket 18 in mechanical connection and/or electrical reconnection to the electrical lighting base 16; and/or (f) electronic circuitry in the base 16 and/or socket 18 (and/or perhaps somewhere else in the lighting product, e.g., in the base of a portable or in the plate of a fixture) that prevents an incandescent light bulb socket from properly functioning once one of the three foregoing conditions has been met (all not shown). This circuitry may detect energy usage levels of the lighting product, or a part thereof, and/or detect signals generated by a functioning fluorescent lighting ballast, and responsively thereafter prevent higher-energy usage, as would be expected to permit an incandescent light bulb to function.

In the exemplary method of the present invention shown in FIG. 10, it is preferable for any bases 16 and/or any removable incandescent light bulb sockets 18 and/or any fluorescent light ballasts 60 to include one or more of the foregoing means for preventing a removable incandescent bulb socket from being reconnected to the electrical lighting base when either (i) the removable incandescent bulb socket 18 has been removed from the electrical lighting base 16 or (ii) a fluorescent lighting ballast has been coupled to the electrical lighting base 16, or (iii) both the removable incandescent bulb socket 18 has been removed from the electrical lighting base 16 and a fluorescent lighting ballast has been coupled to the electrical lighting base 16, or responsive to some other low-energy usage triggering event.

Examples of the structures (a)–(f) discussed above corresponding to the means for preventing a removable incandescent bulb socket from being reconnected to the electrical lighting base are set forth below.

As one example, the base or socket or ballast may have a key lock assembly. For example, the end of the incandescent bulb socket that is removably received by the base may have one or more structures that extend from the incandescent bulb socket in a direction substantially parallel to the longitudinal axis of the incandescent bulb socket when the incandescent bulb socket is released from the base. Preferably, the base is configured or adapted such that it cannot removably receive the incandescent bulb socket once the structures have extended from the incandescent bulb socket. Preferably, the structures irreversibly extend from the base. The structures may be any suitable size and shape and may be made of any suitable material, e.g. plastic or metal, and may be spring-loaded. For example, the structures may be spring-loaded pins.

As another example, the incandescent socket breaks apart after it is removed from the base, and thus cannot be re-coupled to the base.

As yet another example, a band is broken or cut on the incandescent bulb socket in order to remove the incandescent bulb socket. For instance, there might be a piece of removable material substantially surrounding both the base and incandescent bulb socket such that the material couples the incandescent bulb socket to the base. The user then removes the material to remove the incandescent bulb socket, and consequently, the incandescent bulb socket cannot be re-coupled to the base. The material may be made of any suitable material, e.g. plastic, and may have attached thereto a label indicating that the structure is to be removed to release the incandescent bulb socket.

As still another example, the base or socket or ballast may have a spring-loaded cam or reverse cam assembly. For example, the end of the incandescent bulb socket that is removably received by the base has a one-way cam assembly that is, for example, spring-loaded. The user then pushes inward on the cam assembly to remove the incandescent socket, and upon doing so, the cam assembly irreversibly rotates such that the incandescent bulb socket is released from the base and cannot be re-coupled to the base. The cam assembly may be spring-loaded and contain one or two cams.

As yet another example, the end of the base that removably receives the incandescent bulb socket may have one or more structures that extend in a direction substantially parallel to the longitudinal axis of the incandescent bulb socket when the incandescent bulb socket is removed from the base. The structures may be spring loaded and preferably, the structures irreversibly extend from the incandescent bulb socket. The end of the incandescent bulb socket that is removably received by the base preferably lacks one or more indentations such that it cannot be re-coupled to the base. Preferably, however, once the incandescent bulb socket has been removed, a user may then couple a fluorescent ballast having, for example, one or more indentations on the end of the ballast that receives the base that correspond to the structures. The structures may be any suitable size and shape and may be made of any suitable material, e.g. plastic or metal, and may be spring-loaded. For example, the structures may be spring-loaded pins.

As still another example, the end of the incandescent bulb socket that is removably received by the base may have one or more structures that extend in a direction substantially perpendicular to the longitudinal axis of the incandescent bulb socket when the incandescent bulb socket is removed from the base. Preferably, the base is configured or adapted such that it cannot removably receive the incandescent bulb socket once the structures have extended from the incandescent bulb socket. Preferably, the structures irreversibly extend from the incandescent bulb socket. The structures may be any suitable size and shape and may be made of any suitable material, e.g. plastic or metal, and may be spring-loaded. For example, the structures may be spring-loaded pins.

As another example, the end of the base that removably receives the incandescent bulb socket may have one or more structures that extend in a direction substantially perpendicular to the longitudinal axis of the incandescent bulb socket when the incandescent bulb socket is removed from the base. The structures preferably extend in a direction from the base such that they would interact with the incandescent bulb socket if a user would attempt to re-couple the incandescent bulb socket to the base. Preferably, the structures irreversibly extend from the incandescent bulb socket. The end of the incandescent bulb socket that is removably received by the base preferably lacks one or more indentations such that it cannot be re-coupled to the base. Preferably, however, once the incandescent bulb socket has been removed, a user may then couple a fluorescent ballast having, for example, one or more indentations on the end of the ballast that receives the base that correspond to the structures. The structures may be any suitable size and shape and may be made of any suitable material, e.g. plastic or metal, and may be spring-loaded. For example, the structures may be spring-loaded pins.

Figure 11B:
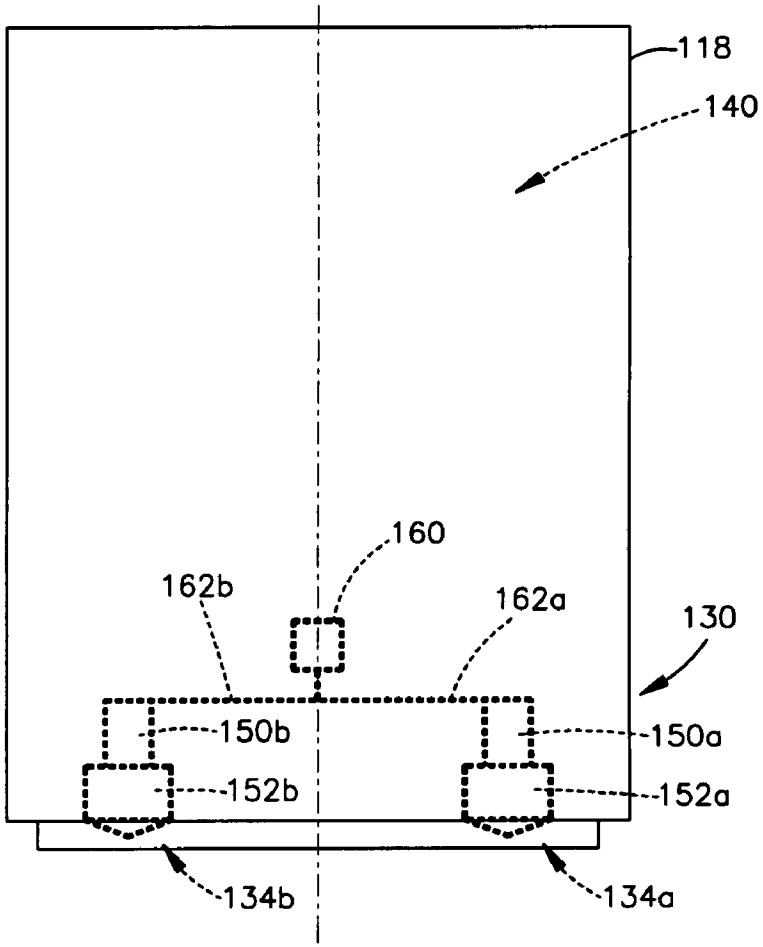
FIGS. 11A and 11B are side views of an exemplary means for preventing a removable incandescent bulb socket from being re-coupled to an electrical lighting base.
Figure 11A:
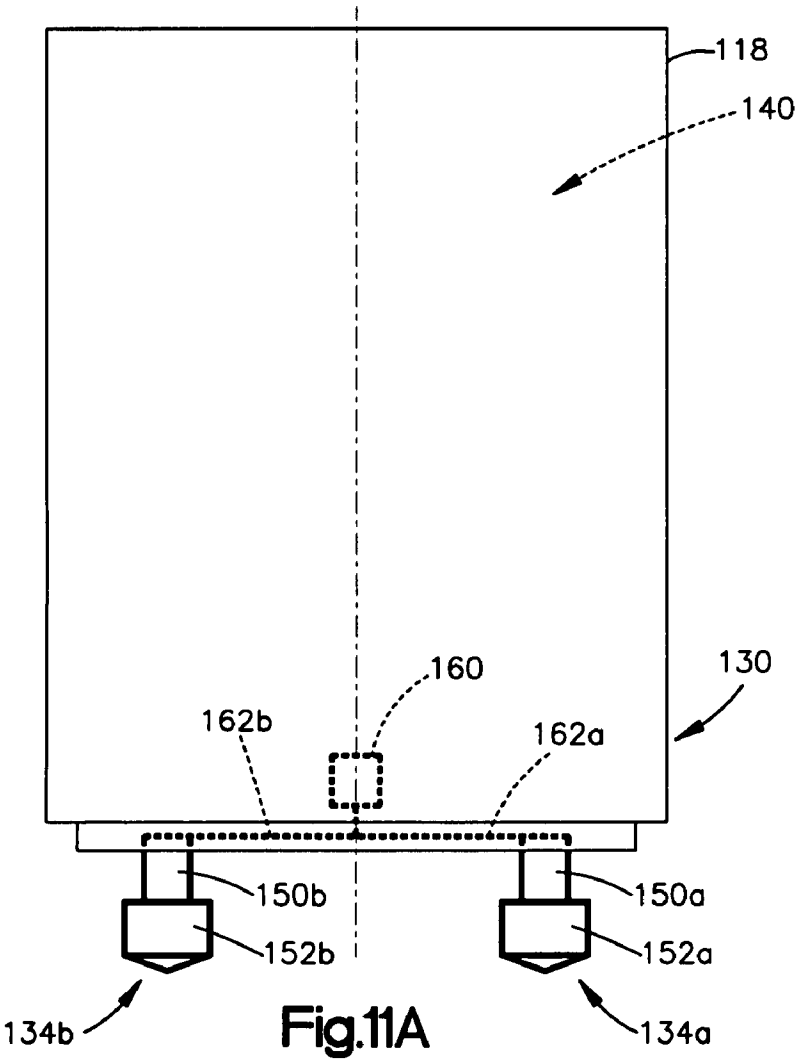

One such example is shown in FIGS. 11A and 11B, which show a removable incandescent bulb socket 118, which preferably is configured so that it may be used with certain commercially available electrical lighting bases, e.g., VIVA GREEN LIGHTING brand model 3.07.03.30025(6) base portion of VIVA GREEN LIGHTING brand removable fluorescent ballasts/base pairs, e.g., VIVA GREEN LIGHTING brand models SU13, SU16, SU23, etc. The exemplary removable incandescent bulb socket 118 is substantially the same as removable incandescent bulb socket 18 described above, having a pair of electrical contact pins 134*a*, 134*b* which are substantially the same as pins 34*a*, 34*b* described above, and having threads 140 which are substantially the same as threads 40 described above. Socket 118 as shown includes means for preventing the removable incandescent bulb socket 118 from being re-connected to an electrical lighting base 16. More specifically, electrical contacts 134*a*, 134*b* of bulb socket 118 are spring-loaded electrical contacts 134*a*, 134*b* that are spring-biased to retract into openings in one end 130 of removable socket 118.

FIG. 11A shows the socket 118 with the electrical contacts 134*a*, 134*b* extended, as would be the case when the socket 118 has been installed into a base 16 (the narrow portion 56 of the openings 36 prevent the spring-loaded electrical contacts 134*a*, 134*b* from retracting). FIG. 11B shows the socket 118 with the electrical contacts 134*a*, 134*b* retracted, as would be the case when the socket 118 is removed from the base 16. When the socket 118 is removed from the base 16, the spring-loaded electrical contacts 134*a*, 134*b* retract, preventing the socket 118 from being readily re-coupled to the base 16. The pins 134*a*, 134*b* need not retract all the way into the socket 118; it is sufficient if they withdraw enough that they cannot be readily extended into the configuration of FIG. 11A for re-coupling to the base 16.

The removable incandescent bulb sockets 118 are preferably coupled to their respective bases 16 during manufacture or assembly. Thus, any lighting product using the exemplary removable incandescent bulb sockets 118 are preferably shipped with the sockets 118 already coupled to their respective bases 16. In the alternative, those in the lighting product distribution channel may couple the sockets 118 to the bases 16. During coupling to the base 16, the electrical contacts 134*a*, 134*b* are extended so that the socket 118 has the configuration of FIG. 11A. A corresponding tool may be used by personnel coupling the sockets 118 to the bases 16. Electrical contacts 134*a*, 134*b* may be spring-loaded before or after the socket 118 is coupled to the base 16. With the electrical contacts 134*a*, 134*b* held in the configuration of FIG. 11A, e.g., with the corresponding tool, the socket 118 may be coupled to the base 16 by aligning the socket 118 with a base 16, inserting the electrical contacts 134*a*, 134*b* into openings 36*a*, 36*b* of base 16, and rotating at least one of the base 16 and the socket 118 with respect to the other. Any corresponding tool used to hold electrical contacts 134*a*, 134*b* in the configuration of FIG. 11A could then be withdrawn. If the electrical contacts 134*a*, 134*b* are not spring-loaded prior to the socket 118 being coupled to the base 16, one or more springs may be operatively connected to the electrical contacts 134*a*, 134*b* to provide a spring force that tends to force them into the configuration of FIG. 11B prior to finishing assembly of the socket 118 after being coupled to base 16. If the electrical contacts 134*a*, 134*b* are spring-loaded prior to the socket 118 being coupled to the base 16, the spring-loaded electrical contacts 134*a*, 134*b* may have an associated pin 160, which can be used to cause the spring-loaded electrical contacts 134*a*, 134*b* to move into the extended configuration of FIG. 11A. Pin 160 may have an operative link 162*a* between the pin 160 and the one spring-loaded electrical contacts 134*a* and an operative link 162*b* between the pin 160 and the other spring-loaded electrical contacts 134*b* operatively connecting the pin 160 to the electrical contacts 134*a*, 134*b* so that when the pin 160 is pushed downward, the spring-loaded electrical contacts 134*a*, 134*b* are moved into the extended configuration of FIG. 11A for assembly. Of course, these operative links 162*a*, 162*b* should not short out the contacts 134*a*, 134*b*, which must remain electrically isolated. Similarly, the pin 160 should not be placed in a position that would interfere with the central contact (not shown) of socket 118. The operative links 162*a*, 162*b* may require more than one action be performed to permit the pin 160 from being pushed to extend the electrical contacts 134*a*, 134*b*, e.g., one opening has a first, spring-loaded pin that must be pushed in half-way before a second pin in a second opening can be pushed to operate the operative links 162*a*, 162*b* to extend the electrical contacts 134*a*, 134*b* into the position of FIG. 11A for coupling to base 16 (not shown). In the foregoing configuration, pushing the first pin more or less than a nominal amount will lock out the second pin from extending the contacts 134*a*, 134*b*. Many configurations are possible, e.g., mechanisms that much be pushed, pulled, slid, twisted, and/or rotated, etc. before a pin may be actuated to extend contacts 134*a*, 134*b*. To help further prevent someone from re-coupling a socket 118 that has been removed to a base 16, whichever opening(s) (not shown) is/are used to either (i) insert the corresponding electrical contact springs or (ii) access the pin 160 during manufacturing are preferably covered, e.g., by positioning a cover or contact (e.g., the central contact 44) over the opening and affixing it in place, e.g., by adhesive, soldering, heat welding, ultrasonic welding, solvent welding, etc. Additionally, such openings are preferably small enough and configured (e.g., small, cylindrical openings) to prevent a user from extending the electrical contacts 134*a*, 134*b* by merely inserting a screw driver into an opening and pushing or twisting.

Figures 12A, 12B:
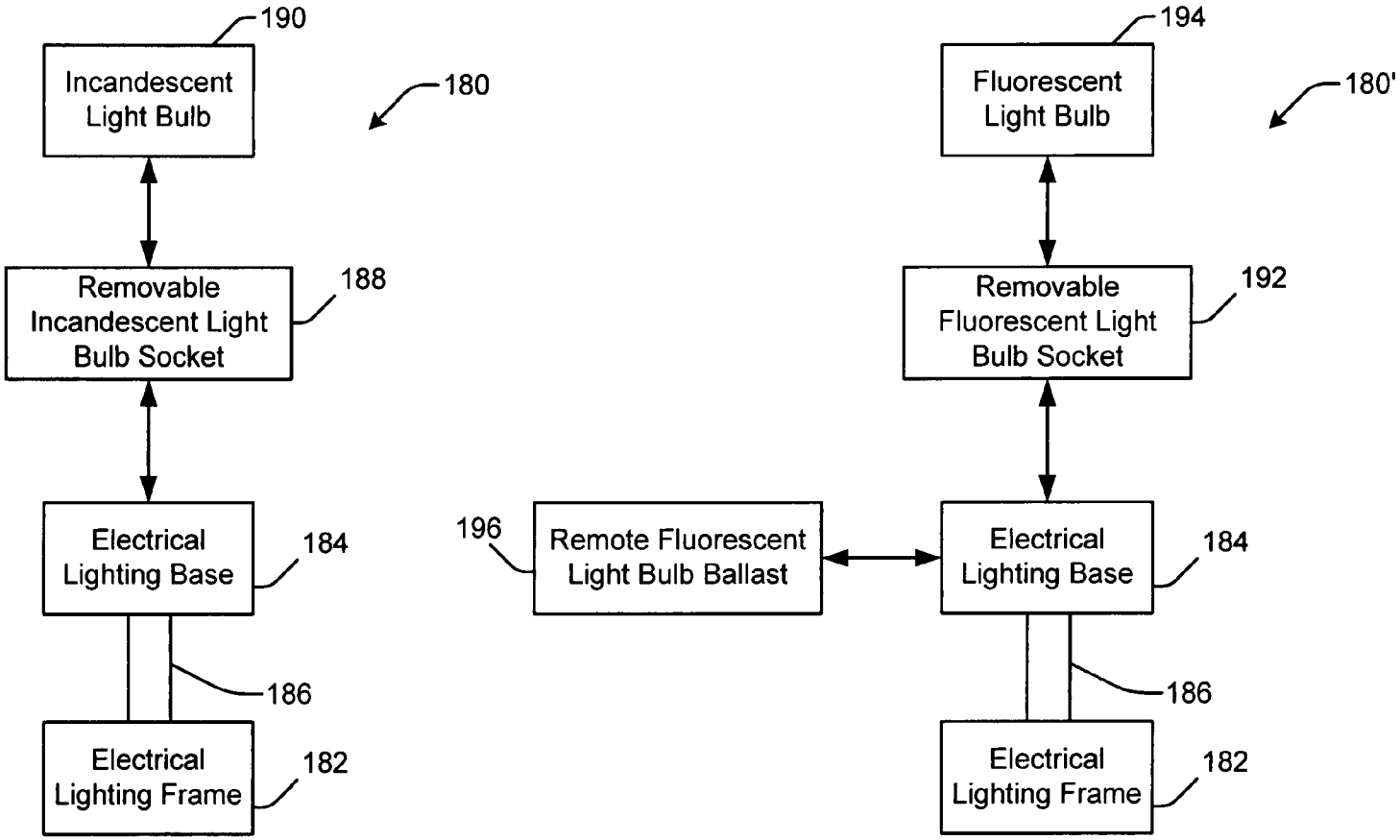
FIGS. 12A, 12B, and 13 are schematic block diagrams of additional exemplary lighting products according to the present invention having remote fluorescent light bulb ballasts.

FIGS. 12A and 12B are high-level block diagrams showing additional exemplary lighting products 180 and 180' according to the present invention having remote fluorescent light bulb ballasts. Exemplary lighting products 180 and 180' comprises a frame 182 carrying at least one electrical lighting base 184. The at least one base 184 may be carried by one or more structures, e.g., carried by at least one arm 186, of the lighting product 180, 180'. The at least one base 184 removably receives, and is electrically coupled to, a removable incandescent bulb socket 188 (FIG. 12A), which accepts an incandescent light bulb 190. Electricity powering the incandescent light bulb 190 is provided via the electrical lighting base 184 to the socket 188. As shown in FIG. 12B, the electrical lighting base 184 also removably receives a removable fluorescent light bulb socket 192 for a fluorescent light bulb 194. The fluorescent light bulb 194 is powered by a remote fluorescent light bulb ballast 196 via electrical lighting base 184 and removable fluorescent light bulb socket 192. The remote fluorescent light bulb ballast 196 is preferably positioned away from the base 184, e.g., behind a back plate, behind a canopy (ceiling cover plate), or within a wiring box associated with the lighting product 180'. The remote fluorescent light bulb ballast 196 may also be built-in behind a wall, e.g., proximate the fixture. Preferably, the electrical lighting base 184 is both mechanically coupled and electrically coupled to the removable incandescent bulb socket 188 and/or the removable fluorescent light bulb socket 192, e.g., the base 184 has openings for accepting and retaining electrical contacts of the removable incandescent bulb socket 188 and the removable fluorescent light bulb socket 192 (not shown in FIGS. 12A and 12B; examples are shown in FIGS. 2–8). In the alternative, the electrical lighting base 184 may be mechanically coupled to the removable incandescent bulb socket 188 and/or the removable fluorescent light bulb socket 192, with electricity being provided by additional conductors (not shown), e.g., external wires extending to the base 184 and/or the removable incandescent bulb socket 188 and/or the removable fluorescent light bulb socket 192.

Figure 13:
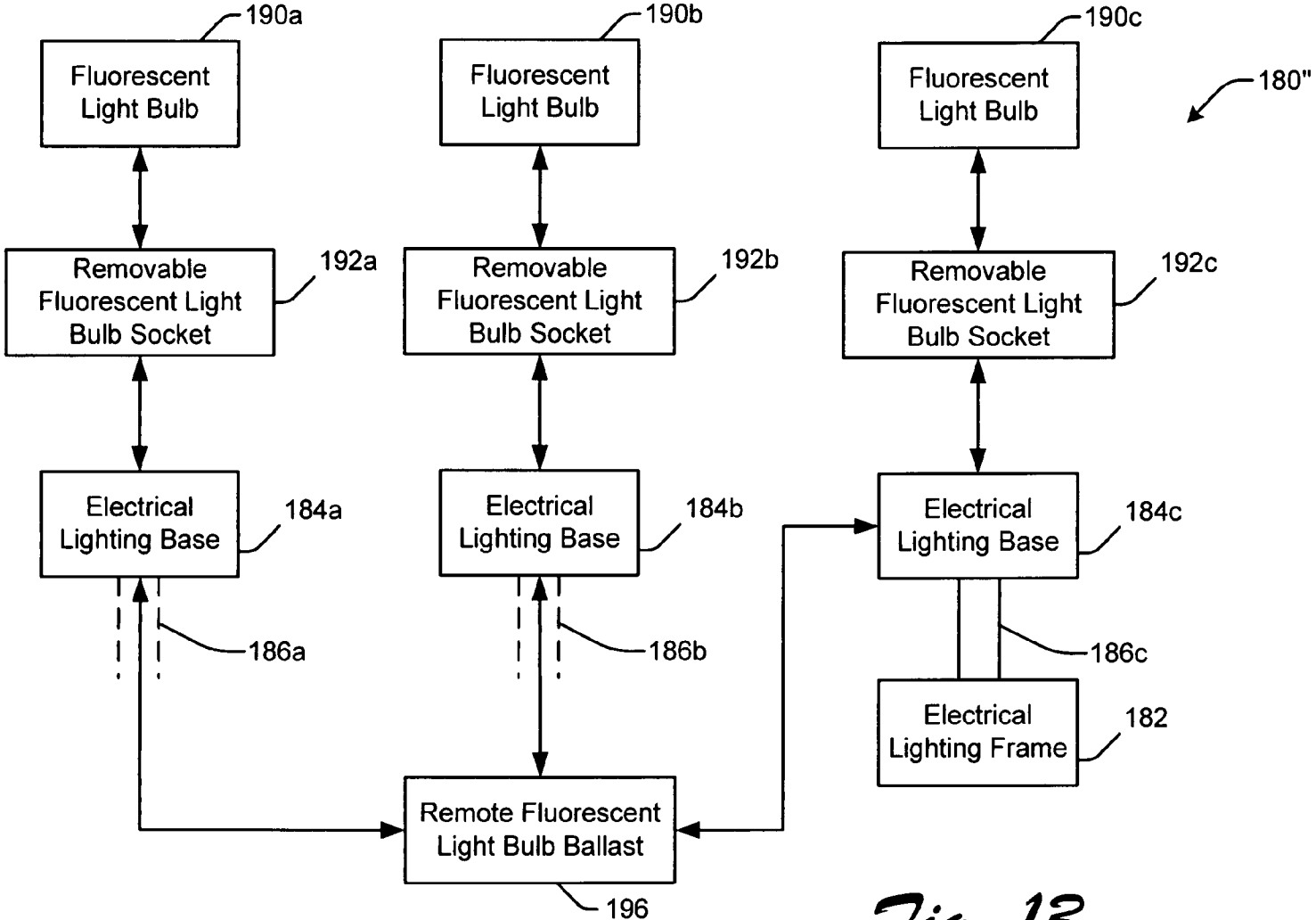

FIG. 13 shows a lighting product 180" very similar to lighting product 180', with the remote fluorescent light bulb ballast 196 providing electricity to a plurality of fluorescent light bulbs 194*a*, 194*b*, 194*c* via a plurality of removable fluorescent light bulb sockets 192*a*, 192*b*, 192*c* carried by a plurality of electrical lighting bases 184*a*, 184*b*, 184*c*. As with the embodiment of FIG. 12B, preferably, the electrical lighting bases 184*a*, 184*b*, 184*c* are both mechanically coupled and electrically coupled to the removable incandescent bulb sockets 188*a*, 188*b*, 188*c* and/or the removable fluorescent light bulb sockets 192*a*, 192*b*, 192*c*, e.g., the bases 184*a*, 184*b*, 184*c* have openings for accepting and retaining electrical contacts of the removable incandescent bulb sockets 188 and the removable fluorescent light bulb sockets 192*a*, 192*b*, 192*c* (not shown in FIG. 13; examples are shown in FIGS. 2–8). In the alternative, the electrical lighting bases 184*a*, 184*b*, 184*c* may be mechanically coupled to the removable incandescent bulb sockets 188 and/or the removable fluorescent light bulb sockets 192*a*, 192*b*, 192*c*, with electricity being provided by additional conductors (not shown), e.g., external wires extending to the bases 184*a*, 184*b*, 184*c* and/or the removable incandescent bulb sockets 188 and/or the removable fluorescent light bulb sockets 192*a*, 192*b*, 192*c*. The bases 184*a*, 184*b*, 184*c* may each be carried by one or more structures, e.g., carried by at least one arm 186*a*, 186*b*, 186*c*, of the lighting product 180".

In accordance with the discussion above, it may be preferable for any bases 184*a*, 184*b*, 184*c* and/or any removable incandescent light bulb socket(s) 188 and/or any removable fluorescent light bulb sockets 192*a*, 192*b*, 192*c* to include one or more of the foregoing means for preventing a removable incandescent bulb socket from being reconnected to the electrical lighting base when either (i) the removable incandescent bulb socket has been removed from the electrical lighting base or (ii) a fluorescent light bulb socket has been coupled to the electrical lighting base, or (iii) both the removable incandescent bulb socket has been removed from the electrical lighting base and a removable fluorescent light bulb sockets has been coupled to the electrical lighting base, or responsive to some other low-energy usage triggering event.

More specifically in the context of FIGS. 12A, 12B, and 13, this may be accomplished by any one or more means for preventing a removable incandescent bulb socket 188 from being reconnected to the electrical lighting base 184, e.g., (a) any one or more spring-loaded electrical contacts associated with the base 184 and/or socket 188 and/or socket 192 that initially provide electricity to the bulb 190, but that extend or retract when any of the three foregoing conditions are met to effectively prevent a removable incandescent bulb socket 188 from being mechanically and/or electrically reconnected to the electrical lighting base 184; and/or (b) any one more spring-loaded pins, cams, guides, or other structures associated with the base 184 and/or socket 188 and/or socket 192 that initially are out of the way, but that extend or retract to physically interfere with other structures when any of the three foregoing conditions are met to effectively prevent a removable incandescent bulb socket 188 from being mechanically and/or electrically reconnected to the electrical lighting base 184; and/or (c) a bulb socket 188 that separates into two or more pieces, rendering it unusable, during the process of meeting any of any of the three foregoing conditions, e.g., the socket 188 breaks into two or more pieces when it is removed from or released from the base 184; and/or (d) any one more spring-loaded pins, cams, guides, or other structures associated with the base 184 and/or socket 188 and/or a non-removable socket 192 that initially are out of the way, but that extend or retract to physically interfere with other structures when any of the three foregoing conditions are met to effectively prevent the non-removable socket 192 from being removed from the base 184 (in this case the removable incandescent bulb socket 188 is prevented from being reconnected to the electrical lighting base 184 by the fluorescent socket 192, which is prevented from being removed and which blocks the socket 188 from being re-coupled to the base 184); and/or (e) any one more rings, bands, bridges, ties, tape, films, or other structures associated with the base 184 and/or socket 188 that initially affix the socket 188 to the base 184 so that the socket 188 is mechanically and electrically coupled to the base 184, which rings, bands, bridges, ties, tape, films, or other structures are cut or otherwise severed or disengaged when any of the three foregoing conditions are met (e.g., in order to do so) so that there is not sufficient structure to re-connect the removable incandescent bulb socket 188 in mechanical connection and/or electrical reconnection to the electrical lighting base 184; and/or (f) electronic circuitry in the base 184 and/or socket 188 (and/or perhaps somewhere else in the lighting product, e.g., in the base of a portable or in the plate of a fixture) that prevents an incandescent light bulb socket from properly functioning once one of the three foregoing conditions has been met (all not shown in FIGS. 1A and 1B). This circuitry may detect energy usage levels of the lighting product, or a part thereof, and/or detect signals generated by a functioning fluorescent lighting socket 192, and responsively thereafter prevent higher-energy usage, as would be expected to permit an incandescent light bulb to function. These means have been discussed in the context of FIGS. 12A, 12B, and 13; however, these means may also be used in connection with the other embodiments described herein, in the sense that the removable fluorescent ballasts herein, e.g., ballast 60, may include a ballast in circuit communication with a socket accepting a fluorescent bulb, as shown in FIG. 7.

In an exemplary method of the present invention, it is preferable for any bases 184 and/or any removable incandescent light bulb sockets 188 and/or any fluorescent light sockets 192 to include one or more of the foregoing means for preventing a removable incandescent bulb socket 188 from being reconnected to the electrical lighting base 184, responsive to any of the three listed low-energy usage triggering events or responsive to some other low-energy usage triggering event.

As discussed above, lighting products according to the present invention may be packaged and shipped in the configuration of FIG. 3A or the configuration of FIG. 2. It may be preferable to ship lighting products according to the present invention in virtually any other configurations shown, e.g., in the configuration of FIG. 9, with or without fluorescent light bulbs installed or packaged therewith. To facilitate these various options, it may be helpful to have a number of "kits," with each kit corresponding to one of the various optional configurations. For example, if a lighting product is shipped in the configuration of FIG. 2, i.e., no incandescent bulb socket or fluorescent ballast or fluorescent socket installed in each base, it may be helpful to have any one or more of the following kits available to ship with the lighting product so-packaged and/or available to ship separately for conversion of a lighting product: (a) a kit containing any number of any of the removable incandescent bulb sockets discussed herein for connection to the base(s), (b) a kit containing any number of any of the fluorescent light bulb ballasts discussed herein for connection to the base(s), (c) a kit containing any number of any of the fluorescent bulb sockets discussed herein for connection to the base(s) and for connection to at least one remote fluorescent ballast, (d) a kit containing any number of any of the fluorescent bulb sockets discussed herein for connection to the base(s) along with at least one fluorescent ballast for remote installation and connection to the fluorescent bulb sockets. Any of these kits may also optionally include (i) any tool or tools required to connect removable incandescent bulb sockets to the bases and properly configure any means for preventing the removable incandescent bulb socket from being re-coupled to the electrical lighting base and/or (ii) any tool or tools required to connect ballasts to the bases and properly configure any means for preventing a removable incandescent bulb socket from being re-coupled to the electrical lighting base. Similarly, any of these kits may also optionally include any number of light bulbs corresponding to components of the kit, e.g., a number of fluorescent light bulbs included in a kit of fluorescent bulb ballasts or fluorescent light bulb sockets.

While the present invention has been illustrated by the description of embodiments thereof, and while the embodiments have been described in some detail, it is not the intention of the applicant to restrict or in any way limit the scope of the appended claims to such detail. Additional advantages and modifications will readily appear to those skilled in the art. For example, the teachings herein may be used with virtually any type of lighting products (fixtures or portables), including without limitation Tiffany style lighting, recessed lighting, track lighting, fan lighting, hospitality lighting, landscape lighting, site lighting, accent lighting, ADA lighting (fixtures for mounting on a wall that extend no more than a specified amount, e.g., 4 inches, from the wall to comply with the Americans with Disabilities Act), architectural lighting, built-in lighting, valance lighting, etc. In addition, the embodiments shown include Edison base incandescent light bulbs and sockets accepting Edison base light bulbs; the teachings of the present application can be applied to virtually any size and type of lighting base, e.g., medium base, candle base, 3-way medium base, mogul base, intermediate base, medium base with built in dimmer, and mini can halogen. Additionally, although the teachings of the present invention are recited in the context of conversion from incandescent lighting to fluorescent lighting, the present invention is also directed toward conversion from virtually any lighting type to virtually any other lighting type: standard incandescent lighting, fluorescent lighting, halogen lighting, high-pressure sodium lighting, low-pressure sodium lighting, mercury vapor lighting, metal halide lighting, etc. Moreover, the steps of the methods described and claimed in the present application may be performed in any suitable order. Therefore, the invention in its broader aspects is not limited to the specific details, representative apparatus and methods, and illustrative examples shown and described. Accordingly, departures may be made from such details without departing from the spirit or scope of the applicant's general inventive concept.

What is claimed is:

1. A removable incandescent light bulb socket for being electrically and mechanically coupled to an electrical lighting base having at least two openings, each opening having a wider portion and a narrower portion, comprising:

(a) a housing having at least first and second ends and an axis, having at least one opening at the first end, and the housing made at least in part of a heat-resistant material resistant to a temperature of about 90° C.;

(b) threads within the opening for accepting and electrically connecting to a screw thread contact of an incandescent light bulb;

(c) a central contact within the opening for electrically connecting to an electrical foot contact of the incandescent light bulb;

(d) first and second electrical contacts extending from the second end of the housing substantially parallel to the housing axis for mechanical and electrical connection to the electrical lighting base; and (e) means for preventing the removable incandescent bulb socket from being re-coupled to the electrical lighting base responsive to a low-energy usage triggering event; and (f) wherein the first electrical contact is electrically connected to the housing threads to provide electricity from the electrical lighting base to the screw thread contact of the incandescent light bulb, (g) wherein the second electrical contact is electrically connected to the central contact to provide electricity from the electrical lighting base to the electrical foot contact of the incandescent light bulb;

(h) wherein the first and second electrical contacts have central axes and are positioned so that their central axes are approximately parallel; and (i) further wherein the first and second electrical contacts each have a narrower proximal portion and a wider distal portion, the wider distal portion being configured to be accepted by the wider portion of tie openings of the electrical lighting base and retained in the narrower portion of the openings of the electrical lighting base.

2. The removable incandescent light bulb socket for being electrically and mechanically coupled to an electrical lighting base having at least two openings according to claim 1, wherein the low-energy usage triggering event corresponding to the means for preventing the removable incandescent bulb socket from being re-coupled to the electrical lighting base comprises the removable incandescent bulb socket having been removed from the electrical lighting base.

3. The removable incandescent light bulb socket for being electrically and mechanically coupled to an electrical lighting base having at least two openings according to claim 1, wherein the low-energy usage triggering event corresponding to the means for preventing the removable incandescent bulb socket from being re-coupled to the electrical lighting base comprises a fluorescent lighting socket having been coupled to the electrical lighting base.

4. The removable incandescent light bulb socket for being electrically and mechanically coupled to an electrical lighting base having at least two openings according to claim 1, wherein the low-energy usage triggering event corresponding to the means for preventing the removable incandescent bulb socket from being re-coupled to the electrical lighting base comprises a fluorescent lighting socket having an integral ballast having been coupled to the electrical lighting base.

5. The removable incandescent light bulb socket for being electrically and mechanically coupled to an electrical lighting base having at least two openings according to claim 1, wherein the low-energy usage triggering event corresponding to the means for preventing the removable incandescent bulb socket from being re-coupled to the electrical lighting base comprises both the removable incandescent bulb socket having been removed from the electrical lighting base and a fluorescent lighting socket having been coupled to the electrical lighting base.

6. The removable incandescent light bulb socket for being electrically and mechanically coupled to an electrical lighting base having at least two openings according to claim 1, wherein the low-energy usage triggering event corresponding to the means for preventing the removable incandescent bulb socket from being re-coupled to the electrical lighting base comprises at least one of the following conditions:

(a) the removable incandescent bulb socket having been removed from the electrical lighting base; and (b) a fluorescent lighting socket having been coupled to the electrical lighting base.

7. The removable incandescent light bulb socket for being electrically and mechanically coupled to an electrical lighting base having at least two openings according to claim 1, wherein at least one of the first and second electrical contacts is biased so as to retract at least partially into the housing when removed from the electrical lighting base to prevent the removable incandescent light bulb socket from being re-coupled to the electrical lighting base.

8. The removable incandescent light bulb socket for being electrically and mechanically coupled to an electrical lighting base having at least two openings according to claim 1, wherein the first and second electrical contacts are biased so as to retract at least partially into the housing when removed from the electrical lighting base to prevent the removable incandescent light bulb socket from being re-coupled to the electrical lighting base.

9. The removable incandescent light bulb socket for being electrically and mechanically coupled to an electrical lighting base having at least two openings according to claim 1, wherein at least one of the first and second electrical contacts is spring biased so as to retract at least partially into the housing when removed from the electrical lighting base to prevent the removable incandescent light bulb socket from being re-coupled to the electrical lighting base.

10. The removable incandescent light bulb socket for being electrically and mechanically coupled to an electrical lighting base having at least two openings according to claim 1, wherein the first and second electrical contacts are spring biased so as to retract at least partially into the housing when removed from the electrical lighting base to prevent the removable incandescent light bulb socket from being re-coupled to the electrical lighting base.

11. The removable incandescent light bulb socket for being electrically and mechanically coupled to an electrical lighting base having at least two openings according to claim 1, wherein the first and second electrical contacts are rigidly connected to the housing.

12. The removable incandescent light bulb socket for being electrically and mechanically coupled to an electrical lighting base having at least two openings according to claim 1, wherein the first and second electrical contacts are rigidly connected directly to the housing.

13. The removable incandescent light bulb socket for being electrically and mechanically coupled to an electrical lighting base having at least two openings according to claim 1, wherein the housing is made at least in part of a bakelite polymer material.

14. The removable incandescent light bulb socket for being electrically and mechanically coupled to an electrical lighting base having at least two openings according to claim 1, wherein the housing is made at least in part of a ceramic material.

15. The removable incandescent light bulb socket for being electrically and mechanically coupled to an electrical lighting base having at least two openings according to claim 1, wherein the means for preventing the removable incandescent bulb socket from being re-coupled to an electrical lighting base comprises: at least one spring-loaded electrical contact associated with the housing that initially provides electricity to an incandescent light bulb from the electrical lighting base, and that moves to prevent the removable incandescent bulb socket from being mechanically re-coupled to the electrical lighting base responsive to at least one of the following conditions:

(a) the removable incandescent bulb socket having been removed from the electrical lighting base; and (b) a fluorescent lighting socket having been coupled to the electrical lighting base.

16. The removable incandescent light bulb socket for being electrically and mechanically coupled to an electrical lighting base having at least two openings according to claim 1, wherein the means for preventing the removable incandescent bulb socket from being re-coupled to an electrical lighting base comprises: at least two spring-loaded electrical contacts associated with the housing that initially provide electricity to an incandescent light bulb from the electrical lighting base, and that move to prevent the removable incandescent bulb socket from being mechanically re-coupled to the electrical lighting base responsive to at least one of the following conditions:

(a) the removable incandescent bulb socket having been removed from the electrical lighting base; and (b) a fluorescent lighting socket having been coupled to the electrical lighting base.

17. The removable incandescent light bulb socket for being electrically and mechanically coupled, to an electrical lighting base having at least two openings according to claim 1, wherein the means for preventing the removable incandescent bulb socket from being re-coupled to an electrical lighting base comprises: at least one spring-loaded pin associated with the housing that initially is out of the way, but that moves to prevent the removable incandescent bulb socket from being mechanically re-coupled to the electrical lighting base responsive to at least one of the following conditions:

(a) the removable incandescent bulb socket having been removed from the electrical lighting base; and (b) a fluorescent lighting socket having been coupled to the electrical lighting base.

18. The removable incandescent light bulb socket for being electrically and mechanically coupled to an electrical lighting base having at least two openings according to claim 1, wherein the means for preventing the removable incandescent bulb socket from being re-coupled to an electrical lighting base comprises: at least one spring-loaded cam associated with the housing that initially is out of the way, but that moves to prevent the removable incandescent bulb socket from being mechanically re-coupled to the electrical lighting base responsive to at least one of the following conditions:

(a) the removable incandescent bulb socket having been removed from the electrical lighting base; and (b) a fluorescent lighting socket having been coupled to the electrical lighting base.

19. The removable incandescent light bulb socket for being electrically and mechanically coupled to an electrical lighting base having at least two openings according to claim 1, wherein the means for preventing the removable incandescent bulb socket from being re-coupled to an electrical lighting base comprises: at least one spring-loaded guide associated with the housing that initially is out of the way, but that moves to prevent the removable incandescent bulb socket from being mechanically re-coupled to the electrical lighting base responsive to at least one of the following conditions:

(a) the removable incandescent bulb socket having been removed from the electrical lighting base; and (b) a fluorescent lighting socket having been coupled to the electrical lighting base.

20. The removable incandescent light bulb socket for being electrically and mechanically coupled to an electrical lighting base having at least two openings according to claim 1, wherein the means for preventing the removable incandescent bulb socket from being re-coupled to an electrical lighting base comprises; the housing separating into two or more pieces, rendering it unusable to connect a light bulb to the electrical lighting base, responsive to at least one of the following conditions:

(a) the removable incandescent bulb socket having been removed from the electrical lighting base; and (b) a fluorescent lighting socket having been coupled to the electrical lighting base.

21. The removable incandescent light bulb socket for being electrically and mechanically coupled to an electrical lighting base having at least two openings according to claim 1, wherein the means for preventing the removable incandescent bulb socket from being re-coupled to an electrical lighting base comprises: one or more structures associated with the housing that initially affix the removable incandescent light bulb socket to the electrical lighting base so that the removable incandescent light bulb socket is mechanically coupled to the base, which when cut result in there being insufficient structure to re-couple the removable incandescent bulb socket to the electrical lighting base.

22. A removable incandescent light bulb socket for being electrically and mechanically coupled to an electrical lighting base having at least two openings, each opening having a wider portion and a narrower portion, comprising:

(a) a housing having at least first and second ends and an axis, having at least one opening at the first end, and the housing made at least in part of a heat-resistant material resistant to a temperature of about 90° C.;

(b) threads within the opening for accepting and electrically connecting to a screw thread contact of an incandescent light bulb;

(c) a central contact within the opening for electrically connecting to an electrical foot contact of the incandescent light bulb;

(d) first and second electrical contacts extending from the second end of the housing substantially parallel to the housing axis for mechanical and electrical connection to the electrical lighting base; and (e) a spring-loaded portion that prevents the removable incandescent bulb socket from being re-coupled to the electrical lighting base responsive to a low-energy usage triggering event; and (f) wherein the first electrical contact is electrically connected to the housing threads to provide electricity from the electrical lighting base to the screw thread contact of the incandescent light bulb, (g) wherein the second electrical contact is electrically connected to the central contact to provide electricity from the electrical lighting base to the electrical foot contact of the incandescent light bulb;

(h) wherein the first and second electrical contacts have central axes and are positioned so that their central axes are approximately parallel; and (i) further wherein the first and second electrical contacts each have a narrower proximal portion and a wider distal portion, the wider distal portion being configured to be accepted by the wider portion of the openings of the electrical lighting base and retained in the narrower portion of the openings of the electrical lighting base.

23. A removable incandescent light bulb socket for being electrically and mechanically coupled to an electrical lighting base having at least two openings, each opening having a wider portion and a narrower portion, comprising:

(a) a housing having at least first and second ends and an axis, having at least one opening at the first end, and the housing made at least in part of a heat-resistant material resistant to a temperature of about 90° C.;

(b) threads within the opening for accepting and electrically connecting to a screw thread contact of an incandescent light bulb;

(c) a central contact within the opening for electrically connecting to an electrical foot contact of the incandescent light bulb;

(d) first and second electrical contacts extending from the second end of the housing substantially parallel to the housing axis for mechanical and electrical connection to the electrical lighting base; and (e) wherein the first electrical contact is electrically connected to the housing threads to provide electricity from the electrical lighting base to the screw thread contact of the incandescent light bulb, (f) wherein the second electrical contact is electrically connected to the central contact to provide electricity from the electrical lighting base to the electrical foot contact of the incandescent light bulb;

(g) wherein the first and second electrical contacts have central axes and are positioned so that their central axes are approximately parallel; and (h) further wherein the first and second electrical contacts each have a narrower proximal portion and a wider distal portion, the wider distal portion being configured to be accepted by the wider portion of the openings of the electrical lighting base and retained in the narrower portion of the openings of the electrical lighting base.

24. The removable incandescent light bulb socket for being electrically and mechanically coupled to an electrical lighting base having at least two openings according to claim 23, wherein the first and second electrical contacts are rigidly connected to the housing.

25. The removable incandescent light bulb socket for being electrically and mechanically coupled to an electrical lighting base having at least two openings according to claim 23, wherein the first and second electrical contacts are rigidly connected directly to the housing.

26. The removable incandescent light bulb socket for being electrically and mechanically coupled to an electrical lighting base having at least two openings according to claim 23, wherein the housing is made at least in part of a bakelite polymer material.

27. The removable incandescent light bulb socket for being electrically and mechanically coupled to an electrical lighting base having at least two openings according to claim 23, wherein the housing is made at least in part of a ceramic material.

* * * * *

UNITED STATES PATENT AND TRADEMARK OFFICE

CERTIFICATE OF CORRECTION

PATENT NO. : 7,090,390 B2
APPLICATION NO. : 11/033090
DATED : August 15, 2006
INVENTOR(S) : Bruce Raymond Pazula It is certified that error appears in the above-identified patent and that said Letters Patent is hereby corrected as shown below:

Column 17, line 53, claim 1, please delete “tie” and insert -- the --.

Column 19, line 54, claim 17, after “coupled” please remove “,”.

Signed and Sealed this

Thirty-first Day of October, 2006

JON W. DUDAS
*Director of the United States Patent and Trademark Office*